US005753005A

United States Patent [19]

Aoki et al.

[11] Patent Number: 5,753,005

[45] Date of Patent: May 19, 1998

[54] SOURCE POWDER FOR WEAR-RESISTANT SINTERED MATERIAL

[75] Inventors: Yoshimasa Aoki, Matsudo; Kei Ishii, Kashiwa; Yukio Tokuyama, Chiba; Yuji Soda, Utsunomiya, all of Japan

[73] Assignees: Hitachi Powdered Metals Co., Ltd., Chiba; Mitsubishi Steel Mfg. Co., Ltd., Tokyo, both of Japan

[21] Appl. No.: 781,271

[22] Filed: Jan. 10, 1997

[30] Foreign Application Priority Data

Jan. 16, 1996 [JP] Japan ..... 8-004979

[51] Int. Cl.[6] ..... C22C 38/60

[52] U.S. Cl. ..... 75/255; 420/87; 420/111; 420/114

[58] Field of Search ..... 75/252, 255; 420/87, 420/111, 114, 122, 124

[56] References Cited

U.S. PATENT DOCUMENTS 4,181,524 1/1980 Bucher et al. ..... 420/87
5,013,524 5/1991 Leban ..... 420/87
5,447,800 9/1995 Dorsch et al. ..... 420/87

FOREIGN PATENT DOCUMENTS 1 583 695 1/1981 United Kingdom .
1 583 777 2/1981 United Kingdom .
1 583 878 2/1981 United Kingdom .
2 284 616 6/1995 United Kingdom .

OTHER PUBLICATIONS

Metals Handbook, 10th edition, vol. 1, pp. 804–810, ASM, 1990.

*Primary Examiner*—George Wyszomierski
*Attorney, Agent, or Firm*—Flynn, Thiel, Boutell & Tanis, P.C.

[57] ABSTRACT

A source powder for a wear-resistant sintered material, consisting essentially of, in weight percentages, Cr: 3.0 to 6.0%, 2 Mo+W: 10.0 to 20.0%, V: 1.0 to 8.0%, Co: 10.0% or below, C: 0.20% to {0.01(2 Mo+W)+0.24 V}%, Si: 0.1 to 1.0%, Mn: 0.1 to 1.0% and the balance being Fe and unavoidable impurities, or one prepared by adding 0.10 to 0.8% of S to the above composition. This powder can be compacted into a green compact having a high green density, which can further give a wear-resistant sintered material having a high sintered density, hardness and strength.

1 Claim, 2 Drawing Sheets

SOURCE POWDER FOR WEAR-RESISTANT SINTERED MATERIAL

BACKGROUND OF THE INVENTION

1. Field of the Invention

The present invention relates to a source powder for a wear-resistant sintered material which is excellent in compressibility.

2. Description of the Prior Art

Powders for high speed steels have frequently been used as the source powders for producing wear-resistant sintered materials. High speed steel is an iron-base alloy containing Cr, W, Mo, V, Cr and so on, which is an extremely hard material consisting essentially of a martensitic matrix phase containing C dissolved in the state of solid solution and precipitated carbides of Mo, W and V and therefore is known as one of the most suitable wear-resistant materials. Accordingly, it is necessary that the carbon content of high speed steel corresponds to {0.01(2 Mo +W)+0.24 V}%, which is the carbon content necessary for forming the carbides of W, Mo and V, plus 0.2 to 0.5%, which is the amount thereof necessary for the solid-solution hardening of martensite. Alloys designed based on this idea have been standardized in Japan, the United States of America and Europe.

Accordingly, the source powder for an wear-resistant sintered material is generally prepared by preliminarily alloying all (inclusive of carbon) of the components necessary to provide a sintered material exhibiting effects as high speed steel after sintering.

Incidentally, the chemical components of high speed tool steels according to JIS G 4403 [1983] are given in Table 1.

by water atomization and thereafter is not subjected to any treatment is too hard to be cold-formed, so that the powder is softened by annealing in a vacuum or reducing atmosphere.

When the powder of the prior art produced by preliminarily alloying all of the components of the composition of high speed steel is subjected to such annealing, C is precipitated as carbides of Cr and Fe in addition to carbides of Mo, W and V, so that the powder is still hard, even after the annealing, and fails in attaining a satisfactory compressive density during cold molding in a metal mold.

A green compact having a low green density exhibits a significant dimensional shrinkage to fail in attaining a satisfactory dimensional accuracy, and undesirably, only a low-density sintered body can be obtained from such a green compact having a low green density, such a sintered body being extremely poor in strength and wear resistance.

A source powder for a wear-resistant sintered material must exhibit excellent compressibility, i.e., a high compressive density in the step of producing a sintered material, though the powder is required to give a sintered material having high wear resistance through hardening after sintering. Therefore, the source powder in itself is required to have low deformation resistance, i.e., to be soft. The present invention aims at providing a source powder for a wear-resistant sintered material satisfying these required contradictory characteristics to thereby enable the production of a material having excellent wear resistance through hardening after sintering.

SUMMARY OF THE INVENTION

The present invention relates to a source powder for a wear-resistant sintered material, consisting essentially of, in

TABLE 1

| | Chemical Composition (%), Balance: Fe | | | | | | | | | |
|---|---|---|---|---|---|---|---|---|---|---|
| Kind | C | Si | Mn | P | S | Cr | Mo | W | V | Co |
| SKH2 | 0.73–0.83 | 0.40 or below | 0.40 or below | 0.030 or below | 0.030 or below | 3.80–4.50 | — | 17.00–19.00 | 0.80–1.20 | — |
| SKH3 | 0.73–0.83 | 0.40 or below | 0.40 or below | 0.030 or below | 0.030 or below | 3.80–4.50 | — | 17.00–19.00 | 0.80–1.20 | 4.50–5.50 |
| SKH4 | 0.73–0.83 | 0.40 or below | 0.40 or below | 0.030 or below | 0.030 or below | 3.80–4.50 | — | 17.00–19.00 | 1.00–1.50 | 9.00–11.00 |
| SKH10 | 1.45–1.60 | 0.40 or below | 0.40 or below | 0.030 or below | 0.030 or below | 3.80–4.50 | — | 11.50–13.50 | 4.20–5.20 | 4.20–5.20 |
| SKH51 | 0.80–0.90 | 0.40 or below | 0.40 or below | 0.030 or below | 0.030 or below | 3.80–4.50 | 4.50–5.50 | 5.50–6.70 | 1.60–2.30 | — |
| SKH52 | 1.00–1.10 | 0.40 or below | 0.40 or below | 0.030 or below | 0.030 or below | 3.80–4.50 | 4.80–6.20 | 5.50–6.70 | 2.30–2.80 | — |
| SKH53 | 1.10–1.25 | 0.40 or below | 0.40 or below | 0.030 or below | 0.030 or below | 3.80–4.50 | 4.60–5.30 | 5.70–6.70 | 2.80–3.30 | — |
| SKH54 | 1.25–1.40 | 0.40 or below | 0.40 or below | 0.030 or below | 0.030 or below | 3.80–4.50 | 4.50–5.50 | 5.30–6.70 | 3.90–4.50 | — |
| SKH55 | 0.85–0.95 | 0.40 or below | 0.40 or below | 0.030 or below | 0.030 or below | 3.80–4.50 | 4.60–5.30 | 5.70–6.70 | 1.70–2.20 | 4.50–5.50 |
| SKH56 | 0.85–0.95 | 0.40 or below | 0.40 or below | 0.030 or below | 0.030 or below | 3.80–4.50 | 4.60–5.30 | 5.70–6.70 | 1.70–2.20 | 7.00–9.00 |
| SKH57 | 1.20–1.35 | 0.40 or below | 0.40 or below | 0.030 or below | 0.030 or below | 3.80–4.50 | 3.00–4.00 | 9.00–11.00 | 3.00–3.70 | 9.00–11.00 |
| SKH58 | 0.95–1.05 | 0.50 or below | 0.40 or below | 0.030 or below | 0.030 or below | 3.80–4.50 | 8.20–9.30 | 1.50–2.10 | 1.70–2.30 | — |
| 5KH59 | 1.00–1.15 | 0.50 or below | 0.40 or below | 0.030 or below | 0.030 or below | 3.80–4.50 | 9.00–10.00 | 1.20–1.90 | 0.90–1.40 | 7.50–8.50 |

Atomization is well known as a process for producing the source powder and, in particular, economical water atomization is most popularly employed. However, a powder having a composition of high speed steel which is prepared weight percentages, Cr: 3.0 to 6.0%, 2 Mo+W: 10.0 to 20.0%, V: 1.0 to 8.0%, Co: 10.0% or below, C: 0.20% to {0.01(2 Mo+W)+0.24 V}%, Si: 0.1 to 1.0%, Mn: 0.1 to 1.0% and the balance being Fe and unavoidable impurities, or one prepared by adding, to the above composition, S in an amount of 0.10 to 0.8% based on the combined weight of the composition and S.

In other words, in the present invention, the carbon content alloyed in the source powder is appropriately controlled with respect to the high speed steel composition excluding carbon. This control enhances the green density of a green compact produced from the resultant powder and improves the dimensional accuracy and density of the compact, thereby enabling the production of a sintered material having improved strength and wear resistance. The deficit in carbon content as compared with that of the regular composition of high speed steel can be covered by adding powdered carbon, particularly powdered graphite, in producing a compact, and the added carbon can be sufficiently homogeneously diffused into the iron-base alloy at a sintering temperature to give finally a sintered material having a wear resistance equivalent to that of the original high speed steel.

DETAILED DESCRIPTION OF THE PREFERRED EMBODIMENTS

Figure 1:
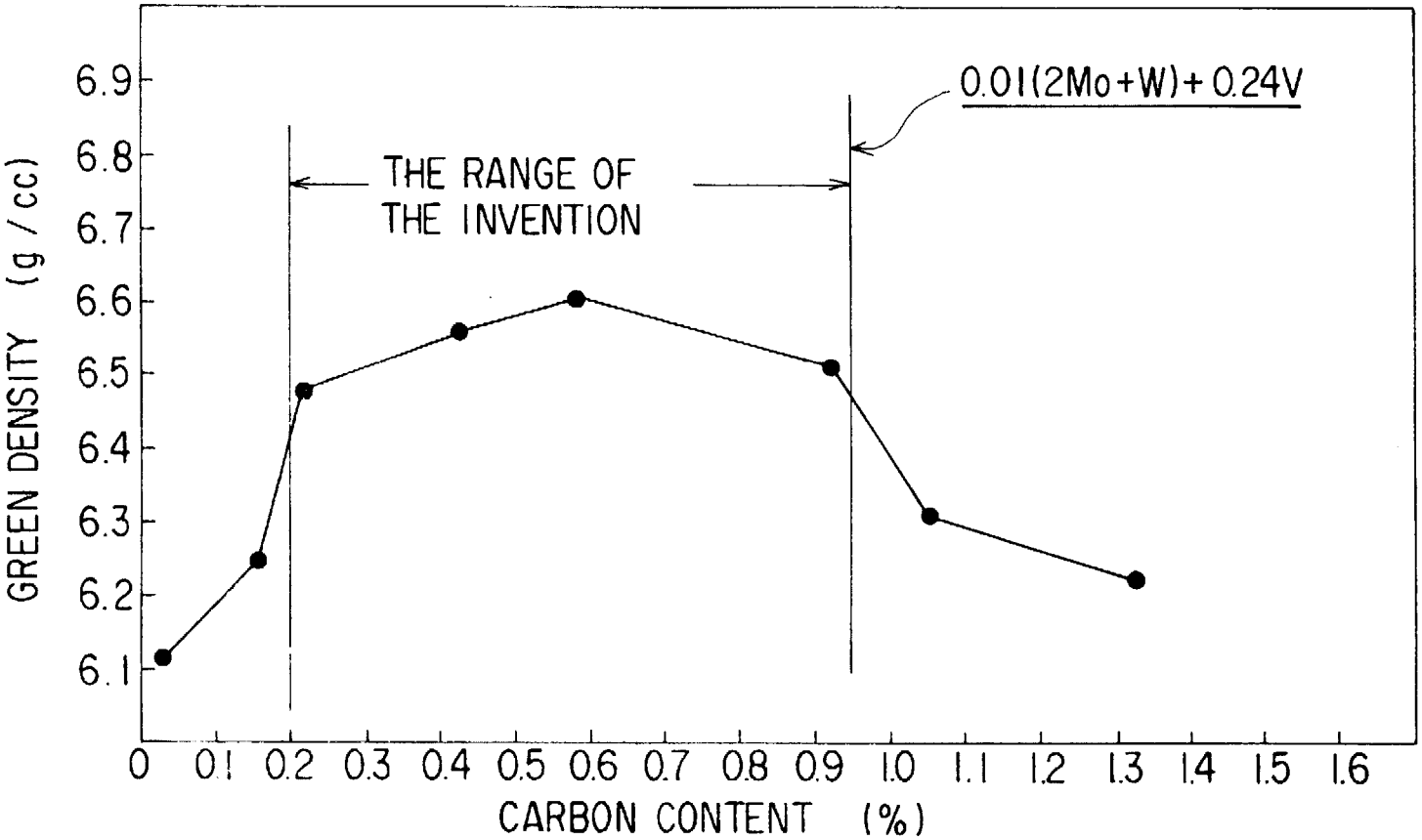
FIG. 1 is a graph showing the green densities of No. 1 to 5 steel powders according to the present invention and comparative No. 1 to 4 steel powders.

The reasons for the restriction on components and their content ranges according to the present invention will now be described, though the reasons with respect to Cr, Mo, W, V and Co are the same as those for the restriction put thereon by the known standards.

Cr: The addition of at least 3.0% of this element remarkably improves the hardenability through the dissolution thereof in a state of solid solution in the matrix phase, though the addition thereof in an amount exceeding 6.0% causes the formation of coarse chromium carbide grains to result in a brittle material.

Mo and W: These elements form their respective hard carbides of $M_6C$ type. The atomic weights of Mo and W are 96 and 184 respectively, so that one unit weight of W is equivalent to about two unit weights of Mo. Accordingly, the proportions of Mo and W can be limited in terms of (2 Mo+W). When the (2 Mo+W) value is less than 10.0%, the amount of precipitated carbides will be too small to attain satisfactory wear resistance, while when it exceeds 20.0%, the amount of carbides will be large and give a brittle material.

V: This element forms a carbide of MC type which is the hardest carbide and therefore enhances the wear resistance remarkably. When the amount of V is less than 1.0%, only a poor effect will be attained, while it exceeds 8.0%, coarse carbide grains will be formed to give a brittle material.

Co: This element is dissolved in a state of solid solution in the matrix phase to enhance the heat resistance. Accordingly, Co is an effective element in producing a material to be used in a high temperature atmosphere. However, Co is extremely expensive, so that it is not always required as an alloying element in the case wherein the resulting sintered material is not used at a high temperature. When Co is alloyed in an amount exceeding 10%, no additional effect will be attained and it is uneconomical.

Si: This element is indispensable as a deoxidizer for the molten alloy. When the amount of Si is less than 0.1%, no effect will be attained, while when it exceeds 1.0%, the resulting material will be brittle.

Mn: This element as well as Si is effective as a deoxidizer. When the amount of Mn exceeds 1.0%, the surface of the resulting powder will tend to suffer from oxidation, while when it is less than 0.1%, no effect will be attained.

C: This element is an element essential to the formation of carbides in high speed steel. In producing a sintered material, however, the alloy constituting the source powder need not essentially contain C, because C can be added in the form of powdered graphite to the powder before molding and the carbon added can be diffused into the powder during sintering to attain the homogeneous alloying with carbon. In a source powder produced by atomizing an alloy not containing carbon at all, MO, W and V, which should form carbides, are dissolved in a state of solid solution in iron or precipitated as intermetallic compounds. Therefore, the atomized powder is harder than that containing a suitable amount of carbon, even after annealing, and exhibits a low green density. When carbon is alloyed in an amount of at least 0.20% in the source powder and annealed, Mo, W and V are precipitated in the form of fine carbides, thereby softening the matrix phase and improving the green density. When the content of C exceeds that necessary for forming $(Mo, W)_6C$ and VC, i.e., the stoichiometric amount {0.01(2 Mo+W)+0.24 V}%, the resulting powder will be extremely hard owing to the presence of excessive C in the matrix phase to give a green compact having a low green density. Thus, the carbon content to be alloyed in the source powder is limited to a range of 0.20% to {0.01(2 Mo+W)+0.24 V}%.

S: This element is present as an impurity generally in an amount of 0.030% or below. In the second aspect of the present invention, a significant amount of S is added, and the S added is bonded with Mn to form MnS, thus improving the machinability remarkably. In the case wherein the sintered material is subjected to mechanical working as the final finishing, the addition of S in an amount of 0.10% or above is effective, but the addition thereof in an amount exceeding 0.80% will give a brittle material.

EXAMPLE

Figure 2:
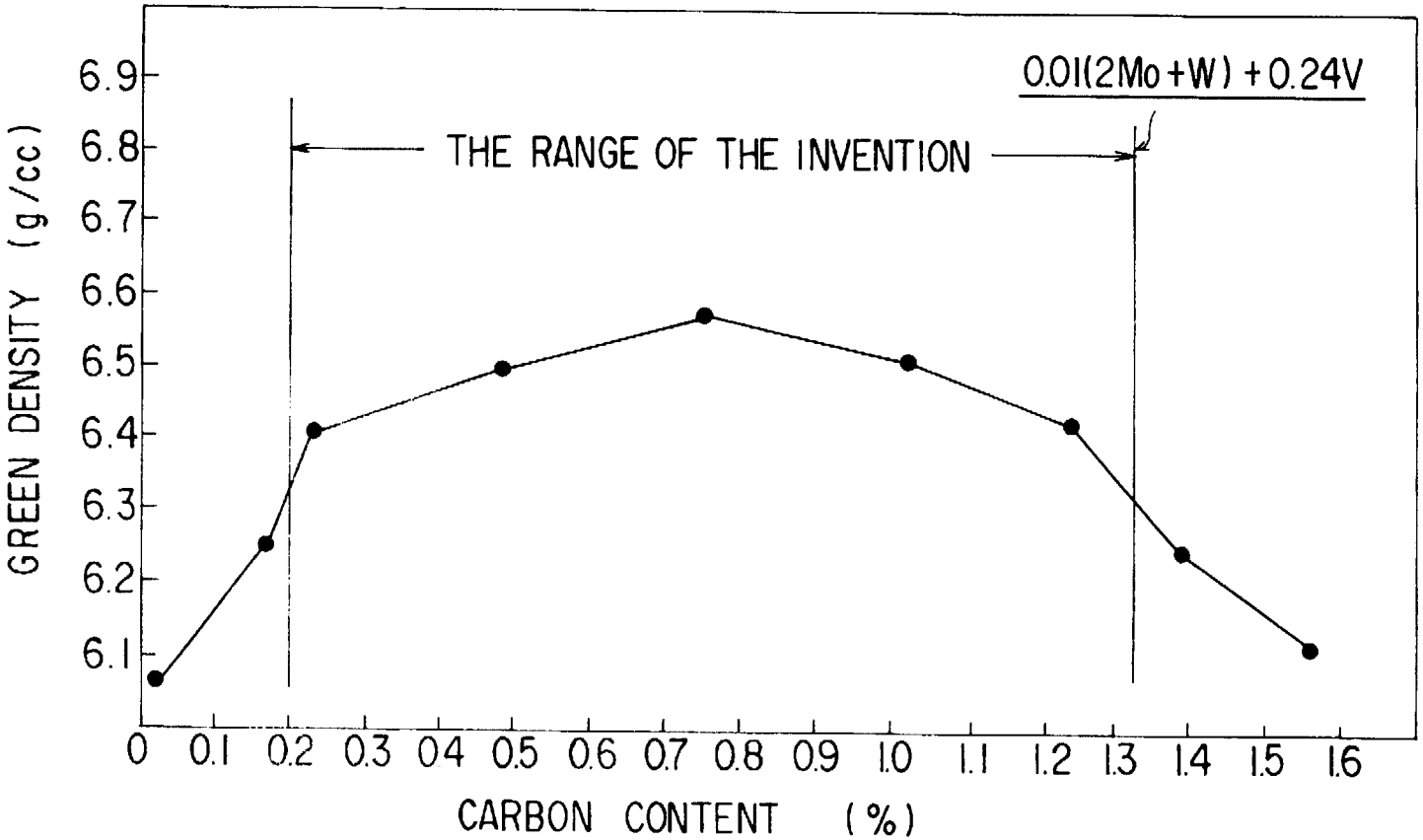
FIG. 2 is a graph showing the green densities of No. 6 to 10 steel powders according to the present invention and comparative No. 5 to 8 steel powders.

Ten molten alloys for steel powders according to the present invention and eight comparative molten alloys therefor as shown in FIG. 2 were each powdered by water atomization and the obtained powders were each annealed by heating at 950° C. and cooling at a cooling rate of 20° C./h.

No. 1 to 5 steel powders according to the present invention correspond to those prepared by reducing the amount of Co in the composition of JIS SKH57 or freeing the composition from Co and regulating the carbon content to be within the range of 0.22 to 0.92% according to the present invention. Incidentally, the standard composition of JIS SKH57 is: C: 1.20%, Cr: 4%, Mo: 3.2%, W: 10%, V: 3.3%, and Co: 10%, wherein the {0.01(2 Mo+W)+0.24 V} value is 0.95%.

Comparative No. 1 and 2 steel powders correspond to those prepared by regulating the carbon content in the above compositions to be below the lower limit of the present invention, while comparative No. 3 and 4 steel powders are those prepared by regulating the carbon content to be above the upper limit of the present invention.

No. 6 to 10 steel powders according to the present invention correspond to those prepared by adding S to the composition of JIS SKH10 for improving the machinability and regulating the carbon content to be in the range of 0.23 to 1.24% according to the present invention. Incidentally, the standard composition of JIS SKH10 is: C: 1.50%, Cr: 4%, W: 12%, V: 5% and Co: 5%, wherein the {0.01(2 Mo+W) +0.24 V} value is 1.32%.

Comparative No. 5 and 6 steel powders correspond to those prepared by regulating the carbon content in the above compositions to be below the lower limit according to the present invention, while comparative No. 7 and 8 steel powders are those prepared by regulating the carbon content to be above the upper limit.

The resulting annealed powders were each mixed with such an amount of powdered graphite that the resulting sintered material has a carbon content equal to original standardized one. Specifically, No. 1 to 5 steel powders according to the present invention and comparative No. 1 to 4 powders were adjusted to a carbon content of 1.20%, while No. 6 to 10 steel powders according to the present invention and comparative No. 5 to 8 powders were adjusted to a carbon content of 1.50%.

Further, 1% of zinc stearate as a lubricant was added to each of the resulting powders. The resulting mixtures were each compacted under a pressure of 6 T/cm$^2$ into a ring having an outer diameter of 36 mm, an inner diameter of 24 mm and a thickness of 3 mm and the obtained rings were examined for green density.

The green compacts were sintered in a vacuum at 1200° C. for one hour and the resulting sintered materials were subjected to a measurement for density, hardness test and radial crush test. The results are given in Table 2.

nine powders with the carbon content on the axis of abscissas, and it can be understood from the figure that the green density can effectively be improved when the carbon content lies within the range of the present invention. Further, it can also be understood from the results given in Table 2 that the green density thus improved directly affects the sintered density, which also has influence on the HRC hardness and the radial crushing strength. Specifically, the HRC hardness and radial crushing strength of sintered materials made from No. 1 to 5 steel powders according to the present invention are 52 or above and 850 MPa or above respectively, while those of sintered materials made from the comparative steel powders are 49.1 or below and 720 MPa or below respectively.

As apparent from the results given in Table 2 and FIG. 2 wherein the results are graphed, it can also be supported in the comparison of No. 6 to 10 steel powders according to the present invention with the corresponding comparative No. 5 to 8 steel powders that when the carbon amount lies within the specific range according to the present invention, the source powder attains a high green density and gives a sintered material having excellent density, hardness and radial crushing strength.

According to the present invention, a source powder for a wear-resistant sintered material which has excellent compressibility can be obtained. This powder can be compacted into a green component having a high green density, which can further give a wear-resistant sintered material having high sintered density, high hardness and high strength.

What is claimed is:

1. A source powder for a wear-resistant sintered material, consisting essentially of the following components: Cr: 3.0 to 6.0%, 2 Mo+W: 10.0 to 20.0%, V: 1.0 to 8.0%, Co: 10.0% or below, C: 0.20% to {0.01(2 Mo+W)+0.24 V}%, Si: 0.1 to 1.0%, Mn: 0.1 to 1.0%, S: 0.10 to 0.80%, all percentages being weight, and the balance being Fe and unavoidable impurities.

TABLE 2

| | Chemicl Composition of Powders (%), Balance: Fe | | | | | | | | | | Properties of Sintered Materials | | | | |
|---|---|---|---|---|---|---|---|---|---|---|---|---|---|---|---|
| | C | Si | Mn | S | Cr | Mo | W | V | Co | 0.01 (2 Mo + W) + 0.24 V | Green Density (g/cc) | Carbon Content (%) | Density (g/cc) | Hard-ness (HRC) | Radial Crushing Strength (MPa) |
| Invention Steel Powders | | | | | | | | | | | | | | | |
| 1 | 0.22 | 0.38 | 0.21 | 0.007 | 4.2 | 3.2 | 9.8 | 3.3 | 0.2 | 0.99 | 6.48 | 1.20 | 6.63 | 52.5 | 850 |
| 2 | 0.43 | 0.25 | 0.18 | 0.003 | 4.1 | 3.1 | 10.1 | 3.4 | — | 0.97 | 6.57 | 1.21 | 6.71 | 53.3 | 890 |
| 3 | 0.58 | 0.41 | 0.31 | 0.004 | 4.3 | 3.4 | 9.5 | 3.2 | 0.5 | 0.93 | 6.61 | 1.25 | 6.74 | 53.8 | 920 |
| 4 | 0.77 | 0.81 | 0.41 | 0.020 | 4.1 | 3.3 | 10.8 | 3.1 | 2.1 | 0.92 | 6.58 | 1.21 | 6.72 | 53.1 | 900 |
| 5 | 0.92 | 0.37 | 0.25 | 0.011 | 4.0 | 3.0 | 9.7 | 3.4 | 1.7 | 0.97 | 6.51 | 1.22 | 6.66 | 52.8 | 880 |
| 6 | 0.23 | 0.31 | 0.61 | 0.25 | 4.1 | — | 12.1 | 4.8 | 5.0 | 1.27 | 6.41 | 1.48 | 6.61 | 53.2 | 810 |
| 7 | 0.48 | 0.73 | 0.55 | 0.61 | 4.1 | — | 11.8 | 4.9 | 5.1 | 1.30 | 6.50 | 1.51 | 6.68 | 53.6 | 830 |
| 8 | 0.75 | 0.65 | 0.80 | 0.70 | 4.2 | — | 11.9 | 5.0 | 4.6 | 1.32 | 6.58 | 1.50 | 6.75 | 54.3 | 900 |
| 9 | 1.02 | 0.55 | 0.77 | 0.51 | 4.1 | — | 12.3 | 4.9 | 4.5 | 1.30 | 6.51 | 1.47 | 6.70 | 54.0 | 870 |
| 10 | 1.24 | 0.76 | 0.67 | 0.46 | 4.0 | — | 11.7 | 5.1 | 4.9 | 1.34 | 6.43 | 1.52 | 6.62 | 53.4 | 820 |
| Comparative Steel Powders | | | | | | | | | | | | | | | |
| 1 | 0.03 | 0.25 | 0.19 | 0.022 | 4.1 | 3.1 | 10.3 | 3.4 | — | 0.98 | 6.12 | 1.21 | 6.30 | 47.8 | 640 |
| 2 | 0.16 | 0.33 | 0.44 | 0.005 | 4.2 | 3.3 | 10.0 | 3.3 | 0.8 | 0.96 | 6.25 | 1.20 | 6.46 | 48.8 | 680 |
| 3 | 1.05 | 0.69 | 0.15 | 0.007 | 4.1 | 3.0 | 9.8 | 3.5 | 3.1 | 1.00 | 6.31 | 1.21 | 6.49 | 49.1 | 720 |
| 4 | 1.33 | 0.56 | 0.39 | 0.005 | 4.0 | 3.4 | 9.7 | 3.2 | — | 0.93 | 6.22 | 1.23 | 6.40 | 48.3 | 670 |
| 5 | 0.02 | 0.62 | 0.86 | 0.58 | 4.0 | — | 12.5 | 4.9 | 4.8 | 1.30 | 6.07 | 1.51 | 6.28 | 50.5 | 610 |
| 6 | 0.17 | 0.66 | 0.78 | 0.39 | 4.1 | — | 12.1 | 5.0 | 4.6 | 1.32 | 6.28 | 1.53 | 6.43 | 51.7 | 660 |
| 7 | 1.39 | 0.83 | 0.43 | 0.54 | 3.9 | — | 12.8 | 4.9 | 5.1 | 1.30 | 6.25 | 1.50 | 6.40 | 51.2 | 640 |
| 8 | 1.56 | 0.87 | 0.61 | 0.63 | 3.8 | — | 11.7 | 5.1 | 4.9 | 1.34 | 6.12 | 1.47 | 6.34 | 50.7 | 630 |

As understood from the results given in Table 2, the green densities of No. 1 to 5 steel powders according to the present invention are 6.48 g/cm$^3$ or above, while those of comparative No. 1 to 4 steel powders corresponding to the above ones of the invention except for carbon content are as low as 6.31 g/cm$^3$ or below. FIG. 1 shows the green densities of the

* * * * *

UNITED STATES PATENT AND TRADEMARK OFFICE

CERTIFICATE OF CORRECTION

PATENT NO. : 5 753 005

DATED : May 19, 1998

INVENTOR(S) : Yoshimasa AOKI et al

It is certified that error appears in the above-indentified patent and that said Letters Patent is hereby corrected as shown below:

Column 6, line 65; change "being weight,"
to ---being by weight,---.

Signed and Sealed this

First Day of September, 1998

*Attest:*

*Attesting Officer*

BRUCE LEHMAN

*Commissioner of Patents and Trademarks*